US007412729B1

(12) United States Patent
McGovern

(10) Patent No.: US 7,412,729 B1
(45) Date of Patent: Aug. 19, 2008

(54) HEAD COVER WITH POCKET

(76) Inventor: Janet McGovern, P.O. Box 205, Monkton, MD (US) 21111

( * ) Notice: Subject to any disclaimer, the term of this patent is extended or adjusted under 35 U.S.C. 154(b) by 551 days.

(21) Appl. No.: 11/187,456

(22) Filed: Jul. 22, 2005

(51) Int. Cl.
*A42B 1/04* (2006.01)

(52) U.S. Cl. ..... 2/174; 2/202

(58) Field of Classification Search ..... 2/174, 2/202, 207, 171, 204, 209.11, 205, 200.1, 2/195.2, 195.3, 68; 132/212; D6/608; D2/880, D2/881
See application file for complete search history.

(56) References Cited

U.S. PATENT DOCUMENTS

| | | | | | |
|---|---|---|---|---|---|
| 770,338 | A * | 9/1904 | Tooher | 2/68 |
| 2,263,418 | A | 11/1941 | Ganim | |
| 2,497,892 | A * | 2/1950 | Klar | 2/68 |
| 2,653,326 | A | 9/1953 | Ged | |
| 2,694,204 | A * | 11/1954 | Cross | 2/174 |
| 2,698,944 | A * | 1/1955 | Ramsby | 2/174 |
| 3,555,565 | A * | 1/1971 | Zimmon | 2/195.7 |
| 5,365,613 | A | 11/1994 | Henegan | |
| 5,490,528 | A | 2/1996 | Day | |
| 5,566,689 | A * | 10/1996 | Yeater | 132/212 |
| 5,708,982 | A * | 1/1998 | Armani | 2/171 |
| 6,427,251 | B1 | 8/2002 | Leach | |
| 6,434,752 | B1 * | 8/2002 | Adams | 2/171 |
| D472,367 | S | 4/2003 | Maya | |
| 6,735,783 | B2 * | 5/2004 | Phillips | 2/202 |
| 7,096,510 | B2 * | 8/2006 | Yeadon | 2/202 |
| 2005/0278830 | A1 * | 12/2005 | Hokin | 2/207 |
| 2007/0056079 | A1 * | 3/2007 | Didier | 2/171 |

* cited by examiner

*Primary Examiner*—Amy B Vanatta
(74) *Attorney, Agent, or Firm*—Lawrence J. Gibney, Jr.

(57) ABSTRACT

This device is a covering that can be easily removed and installed with the use of tie strips. A piece of elastic insures that the device will fit on all shaped heads.

1 Claim, 3 Drawing Sheets

HEAD COVER WITH POCKET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This device relates to headgear and specifically headgear folded and unfolded on an individual's head.

B. Prior Art

This device is related to headgear and there are many references in the prior art. An example of one of those devices is Henegan U.S. Pat. No. 5,365,613, which is a hair drying towel turban. The Henegan device is similar to the device in this case, but different in two essential features: the lack of an elastic strap to size the device and the lack of tie straps to secure it to the person's head.

BRIEF SUMMARY OF THE INVENTION

This device covers the head of an individual. It consists of a towel, a strip of elastic, a set of strips and a pocket. The pocket within the device allows an individual to insert his or her hair into the device. The individual then tightly twists the end of the towel with the pocket and the end of the towel with the pocket is secured with the tie strips. A piece of elastic allows some flexibility with the device to ensure that the device will fit all heads and to insure the comfort of the wearer.

DETAILED DESCRIPTION OF THE EMBODIMENT

Figure 1:
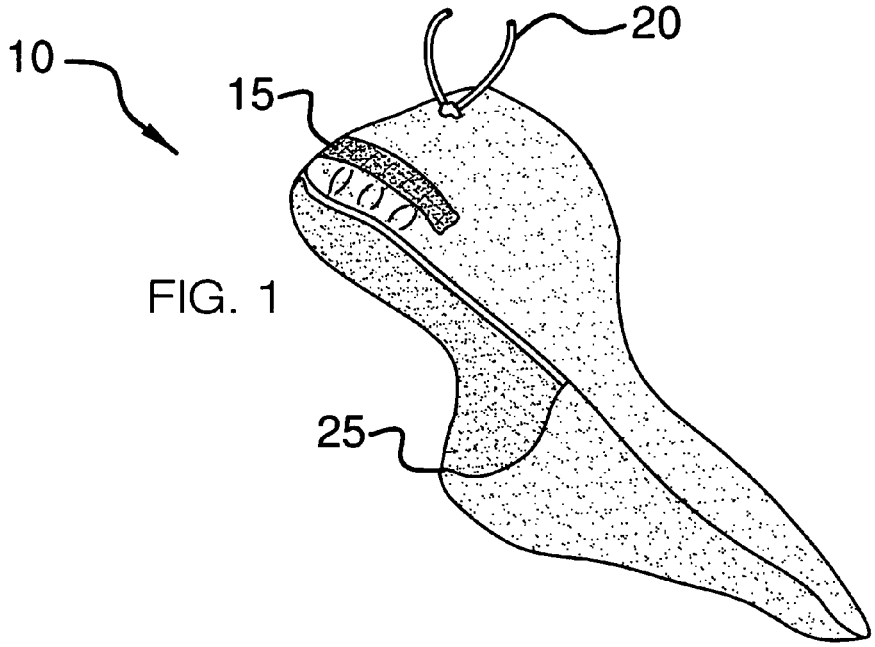
FIG. 1 is an isometric view of the device.
Figure 2:
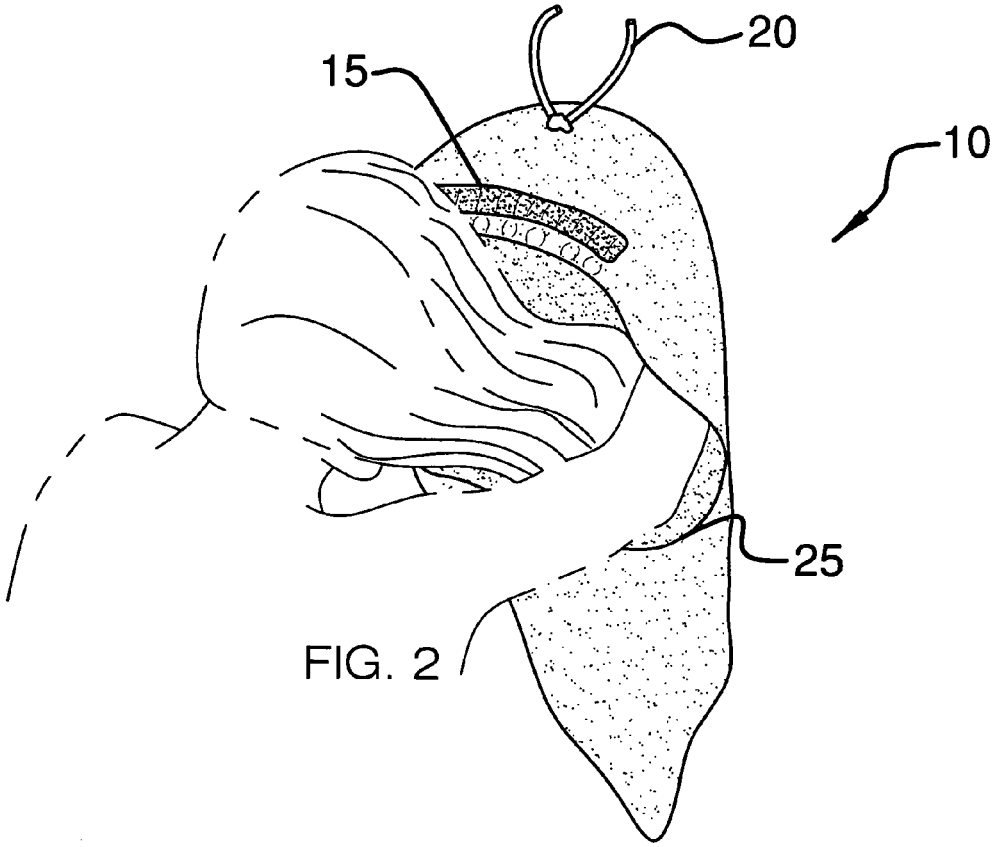
FIG. 2 is a front view of the device with the person inserting their hair.

This device is a towel 10. It is used to cover the person's head and secure their hair after a shower or for simply cosmetic reasons. A hollow pocket 25 is incorporated into the device for inserting the person's hair. FIG. 1, 2 A piece of elastic 15 is placed at a predetermined location on the device to allow the device to stretch. This would enable the device to be placed on any sized head. A set of tie strips 20 adjacent to the elastic 15 in the back of the device enables the individual to secure one end of the device after it has been twisted tightly. The tie strips 20 are connected to the device 10 on the back of the device 10.

Figure 3:
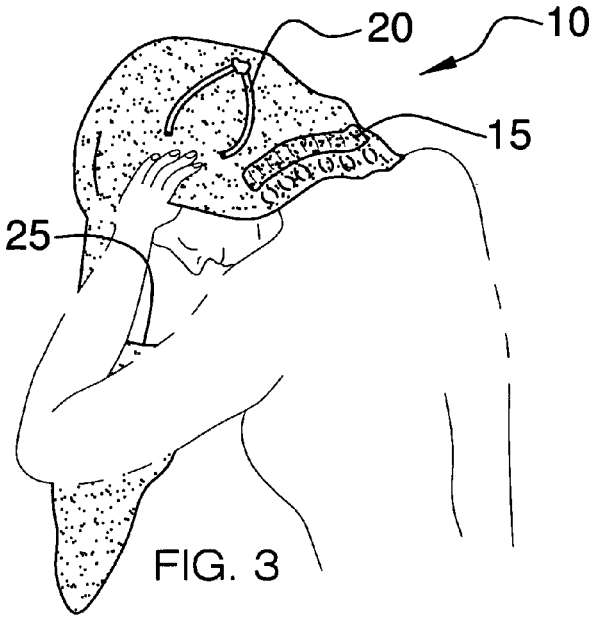
FIG. 3 represents one of the steps in placing the device on the person's head.
Figure 4:
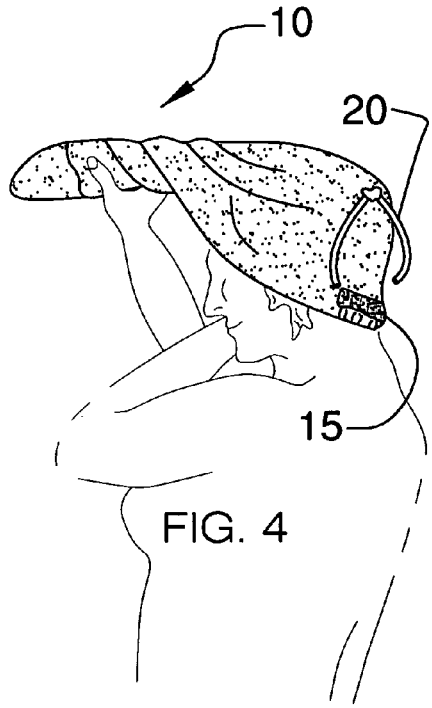
FIG. 4 represents the first step in securing the device on the person's head.
Figure 5:
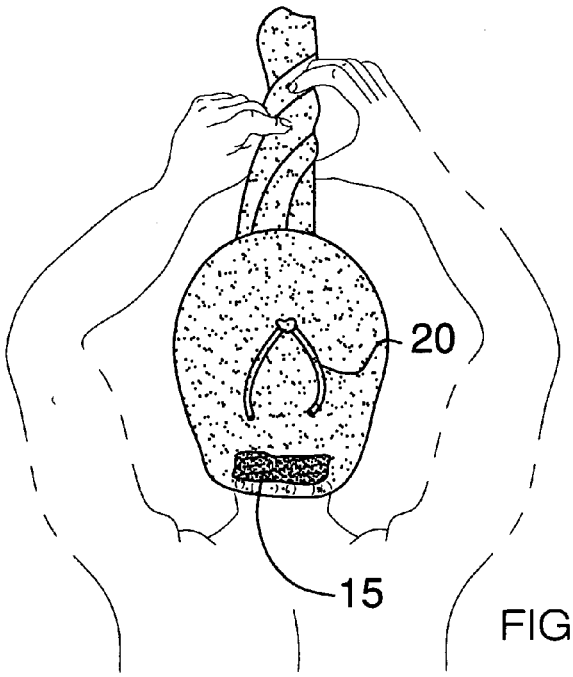
FIG. 5 represents an additional step in securing the device on the person's head.
Figure 6:
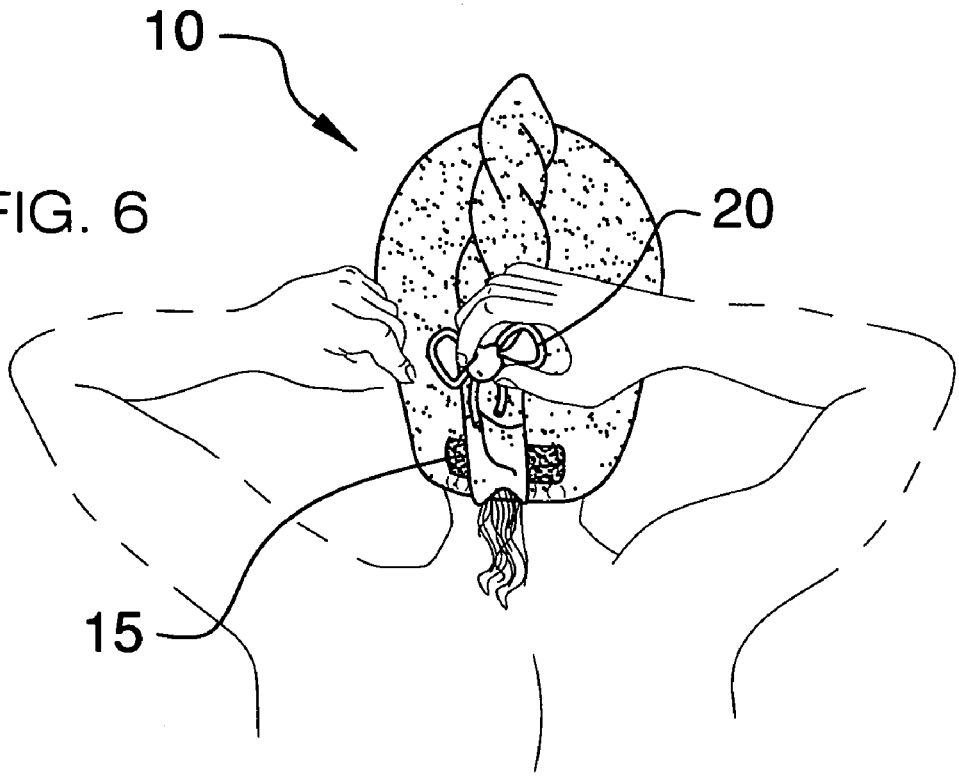
FIG. 6 is a back view of the device with the individual securely tying the device tightly with the strips.
Figure 7:
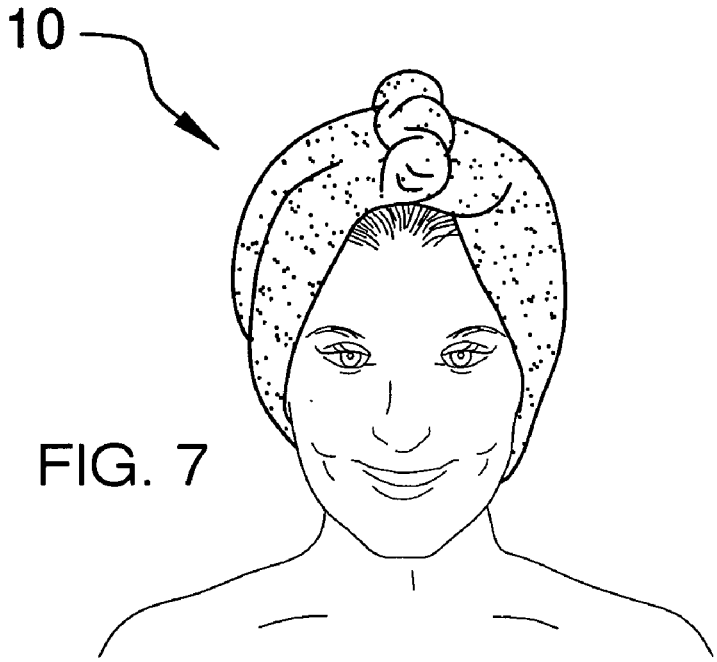
FIG. 7 is a front view of the device after it is placed on the individual's head.

The device 10 is inserted onto the head by first placing the hair inside the pocket 25 and covering the head with the head pouch. The pocket 25 completely covers the person's hair. FIG. 3 The individual then positions the head pouch completely over the back of the head, bringing the elastic strip 15 to the nape or back of the neck. FIG. 4, 6 The piece of elastic 15 and tie strips 20 are positioned on the back of the device near the back of a person's head. FIG. 5, 6 After the device is installed, it will have the appearance of a tightly wrapped towel around an individual's head. FIG. 7 The device is designed to be reusable and therefore should be made of material that can be easily and frequently washed.

While the embodiments of the invention have been disclosed, certain modifications may be made by those skilled in the art to modify the invention without departing from the spirit of the invention.

The inventor claims:

1. A head cover, which is comprised of:

a. towel;

b. elastic;

c. tie strips;

wherein the towel is made with a center pocket for an individual's head and hair;

wherein an elongated section of towel is provided;

said elongated section is of a predetermined length;

said elongated section is placed in the front of the person's head;

wherein the elongated section is twisted tightly and placed over the top of the device;

wherein a portion of the elongated section is secured by a set of tie straps located on the back surface of the device;

wherein a strip of elastic is placed at a predetermined location near the back of the head;

wherein a set of tie strips are placed in close proximity to the elastic strip on the back portion of the device;

wherein one end of the towel is secured to the device using the tie strips.

* * * * *